United States Patent [19]

Schroder

[11] 4,325,993

[45] Apr. 20, 1982

[54] WOOD PRESERVATION PROCESS

[76] Inventor: John G. Schroder, 43 Griffith Ave., Roseville, N.S.W., Australia, 2069

[21] Appl. No.: 96,412

[22] Filed: Nov. 21, 1979

[30] Foreign Application Priority Data

| | | | |
|---|---|---|---|
| Nov. 27, 1978 | [AU] | Australia | PD6917 |
| May 24, 1979 | [AU] | Australia | PD8934 |
| May 30, 1979 | [AU] | Australia | PD9010 |
| Jul. 12, 1979 | [AU] | Australia | PD9565 |

[51] Int. Cl.[3] ..... B05D 1/18; B05D 3/02; B05D 3/12

[52] U.S. Cl. ..... 427/315; 427/317; 427/351; 427/374.1; 427/382; 427/440

[58] Field of Search ..... 427/297, 315, 317, 440, 427/351, 374.1, 382

[56] References Cited

U.S. PATENT DOCUMENTS

| | | | |
|---|---|---|---|
| 2,235,822 | 3/1941 | Boardman | 427/315 |
| 3,080,212 | 3/1963 | Oberley et al. | 427/440 |
| 3,197,272 | 7/1965 | Regutti | 427/315 |
| 3,957,494 | 5/1976 | Oberley | 427/440 X |

*Primary Examiner*—Michael R. Lusignan

*Attorney, Agent, or Firm*—Darby & Darby

[57] ABSTRACT

The present invention relates to a process for preserving wood, in particular hardwoods, against attack by living organisms, e.g. fungi and insects, which destroy wood. In particular, the present invention provides a one or two step process for preserving wood against fungal and/or insect attack. The fungicide treatment step comprises introducing a copper solution or a copper solution into wood. The insecticide treatment step comprises introducing a chromium and arsenic solution into wood. If the pH of the wood system is controlled, both steps may be carried out simultaneously so as to preserve the wood against fungal and insect attack. Alternatively, the insecticide treatment step may follow the fungicide treatment. Where only protection against fungus is desired, the process comprises introducing copper and arsenic solution into wood. On the other hand, if only an insecticide treatment is required, the process comprises only the abovementioned insecticide treatment step. The process according to the present invention can be successfully used to treat wood which has been difficult to treat using conventional methods.

11 Claims, No Drawings

WOOD PRESERVATION PROCESS

The present invention relates to a process for preserving wood, in particular hardwoods, against attack by living organisms which destroy wood.

The term "wood preservation" denotes the treatment of wood with chemicals to impact resistance against living organisms that attack and destroy wood, in particular fungi and insects. Fungi are by far the most important of the living enemies of wood in temperate regions of the world, using wood as a food, thereby lowering its strength. Wood in contact with soil, even in areas of low rainfall, absorbs sufficient moisture to promote fungal decay. Not only does soil act as a reservoir of water, but it also harbours fungi and the essential nutriments therefor, thus acting as a constant source of fungal infection.

Insect attack, in particular termite attack, increases in tropical climates. Termites destroy tremendous quantities of wood in tropical areas and the conditions under which they thrive may also be favourable for fungal attack. Other insects include marine borers which live in saline or brackish waters and are resistant to most types of preservatives, wood-boring molluscs of the Teredo and Bankia type which enter the wood in the form of larvae. Limmoria which are marine animals which form shallow galleries near the surface of the wood resulting in a honeycomb structure, lyctid borer which attacks partially or wholly seasoned sapwood and hardwood with vessel diameters greater than 0.09 mm, (vessel diameters less than 0.09 mm being too small for the borer to insert its egg laying organ), and Bostrychid borer which attack unseasoned wood and wood of high moisture content. Bostrychid borer larvae already present in seasoned wood may continue to destroy the wood and adult insects may later emerge. Bostrychid infestation may also be followed by lyctid infestation when timber is seasoned, as the emergent holes of the Bostrychid borer are sufficiently large for the lyctid borer to insert its egg-laying organ.

PRIOR ART PROCESSES FOR WOOD PRESERVATION

The two main features of the prior art wood preservation processes are the preservatives used and the process of applying it. With regard to the preservatives used in the art, they can be separated into two groups, oil-based preservatives and water based preservative. Each group possesses characteristic advantages and disadvantages.

The oil-based preservatives fall into two main classes namely (i) coal tar creosote and solutions of creosote with coal tar or petroleum oils and (ii) solutions of preservative chemicals, such as pentachlorophenol dissolved in a suitable organic carrier. Such carriers vary greatly in volatility with the choice of carrier depending upon the degree of cleanliness of the treated product required. In the treatments of specialty products that are in the vicinity of, or in contact with foodstuffs, preservatives such as copper-8 quinolinolate and tributyltinoxide (TBTO) dissolved in a light hydrocarbon solvent and applied under pressure can only be used.

Another disadvantage of the oil based preservatives is that they exude from the wood whereby they are washed from the surface or evaporate. In order to compensate for the loss of preservative high initial retentions are required and in tropical and high rainfall areas the use of oil-based preservatives has been found to be uneconomical. There are other disadvantages in that the creosote is objectionable for aesthetic reasons and labour is reluctant to handle creosote treated wood. It is regarded as a skin irritant and can cause burns. Moreover, it cannot be painted and does not have an attractive appearance.

The water based preservatives are those containing chemical preservatives in the form of aqueous solutions, which can react within the wood to form compounds, the solubility of which may be increased by altering the pH thereof. When chemical changes occur within the wood resulting in compounds with very low solubility, the compounds are designated as leach-resistant. Those which form soluble compounds are designated as leachable.

Of the leach-resistant water-based preservatives there are a number in commercial use, e.g. acid copper chromate solution (ACC), chromated copper arsenate solution (CCA) and ammoniacal copper arsenate solution (ACA). CCA solutions are preferred since they form in the wood compounds which are toxic to both fungi and insects. Leachable water based preservatives are chromated zinc chloride and fluoride-chromium-arsenate-phenol mixtures and boron compounds. These preservatives can only be used in treating timber to be used internally or where leaching conditions are not severe.

The advantages of the water-based preservative stem mainly from its cleanliness, paintability of the treated wood, freedom from odour and when correctly applied longer protection of the wood.

Wood preservation methods may be arbitarily divided into two classes, pressure and non-pressure methods. All conventional treatment methods suffer from disadvantages which will be discussed hereinafter.

The essential feature of the pressure method is that the wood is surrounded by a preservative solution in a closed vessel and hydrostatic pressure applied by mechanical means to force the solution into the void spaces in the wood. It is conventional to evacuate the system to about 26" of mercury vacuum to remove air from the cells.

The non-pressure method use physical/chemical phenomena to disperse the preservative solution throughout the wood. The thermal process, also referred to as the "hot and cold" process, comprises immersing wood in successive baths of hot and relatively cool preservative solutions. The most important application of this method lies in the treatment of poles with a naturally durable heartwood and a thin sapwood that can quickly be saturated with solution. Problems however arise when wood with a thick sapwood, such as hardwood is subjected to the process.

A second important physico-chemical process is the double diffusion method wherein greenwood is soaked in an aqueous solution, generally of copper sulphate and then in an aqueous solution generally of an arsenate. The two chemicals diffuse into the wood by ionic diffusion and react to form precipitates that are non-leachable and are generally regarded as being toxic to fungi and termites.

A more recent development has been the introduction of the so-called "modified double diffusion" technique. This is a combination of the thermal process and the diffusion process.

In the modified double diffusion process the wood is first soaked in a hot bath generally of copper sulphate held at a temperature of about 90° C. at a concentration of between 5 and 7.5% such that the temperature of the outer layers of wood reach a temperature of approximately 70° C. This temperature is sufficient to raise the vapour pressure in the wood cells to a point where the air is driven out and a copper and sulphate ions diffuse in. On removal to a cold bath generally of sodium arsenate, condensation of water vapour creates a partial vacuum which causes the infusion and diffusion of sodium and arsenate ions through the wood, the arsenic seeking out the copper and depending on the pH copper arsenate or basic copper arsenate, which are known to be toxic to fungi and most insects are precipitated.

Further refinements have been added to improve the penetration of species that have proven difficult to treat by CCA vacuum pressure techniques, these refinements being, 1. allowing the wood to partially season to a moisture content of 30% to 40% before treatment and 2. incising the outer layers of the wood either in the green state or partially seasoned state.

Regardless of the method of treatment used the success of the method varies greatly between species of wood and even within the same species. In the treatment of hardwood species one finds the greatest differences between species. In some species even the sapwood is difficult to penetrate.

Until the development of the modified double diffusion technology, the treatment of wood by double diffusion means was confined to the preservation of pine species with a porous sapwood for use as fence posts. The modified double diffusion technique has been applied to "hard to treat" (refractory) softwoods such as spruce and hemlock that have not responded to treatment by pressure methods. Because of the simplicity of the process and the small investment required for equipment, the market for preservative treated material has steadily increased with the introduction of modified double diffusion techniques.

While improved fixation and penetration of wood has been achieved by adopting the modified double diffusion technique, it does however suffer from certain disadvantages. Firstly, the time cycle is over four days due to the time that it takes for penetration of the sapwood by the diffusion techniques. This also gives rise to a preservative gradient across the sapwood. Secondly, after the second treatment, a period of two weeks is required to permit the complete diffusion of chemicals in the liquid phase and it is necessary to cover wood with plastic sheeting and keep the wood moist to preserve the liquid phase.

With the use of CCA salts and vacuum pressure technology and with commercial development, the CCA vacuum pressure technique spread rapidly as a method of preserving wood, mostly softwood of the pinus species in the temperate regions of the northern and southern hemispheres. The technique has been attempted from time to time on hardwoods and certain 'hard to treat' softwoods with varying degrees of success but there has been little commercial development. However, of more than 19 million posts treated commercially in the USA in one year, pines accounted for more than 98% of the total treated, while hardwood accounted for less than 2% of the total treated.

In tropical regions hardwood species are dominant and this is particularly so in northern Australia and the ASEAN region. Vacuum pressure techniques using both creosote and CCA salts have been introduced for the treatment of eucalypts and dipterocarp species that are common in the region. The results have been so variable and inconsistent that the practice of treating hardwood posts and poles required for ground contact in highly hazardous tropical conditions is reported to be on the decline and in certain countries the use of this application is prohibited.

The reasons for the failure of the CCA vacuum pressure technique applied to hardwoods are believed to be associated with poor penetration and reaction of the preservatives with extractives in the outer layers of the wood before impregnation is completed through to the heartwood.

When CCA solution is impregnated into hardwood, the solution for the most part travels along the vessels of the sapwood. It has been found that when chromated copper arsenate preservatives are introduced into the vessels by sap displacement, copper and chromium react preferentially and are held in the wood structure. This is confirmed by the fact that the effluent from a treated pole contains twice as much arsenic as chromium and copper. The compounds which are thought to be formed are basic copper chromates and basic chromium chromates. When chromium salts go into solution, hydrolysis occurs producing chromic acid. Chromic acid has been found to adsorb onto the wood structure causing the pH to rise and allowing the chromate ion to react to form basic copper chromate and basic chromium chromate.

When a hardwood pole is subjected to the CCA vacuum pressure technique, a characteristic green/yellow precipitate is deposited on the outside of the pole. A sludge also builds up in the system and this sludge has to be removed periodically. This sludge and the precipitates that are formed on the surface of the pole have been analysed and found to consist predominantly of copper and chromium such as in the form of basic copper chromate and basic chromium chromate. As a result of precipitation, the CCA formulation becomes copper lean and arsenic rich.

In addition, as the solution proceeds through sapwood it also becomes copper lean and arsenic rich and a gradient occurs. This has been confirmed by an analysis across a section of sapwood which shows high levels of copper precipitated in the outer layers, the levels decreasing as the distance from the surface of the wood increases.

Chromates are not a recognised preservative and furthermore their application is as a prophylactic applied to the outer surface of the wood fibres and as such are readily leached or laundered off the wood and lost. This can be observed in what is known as the fading of posts wherein the yellow-green colour of the chromates gradually disappears. Chromates are also undesirable as they are known to be a source of skin irritation and can cause infection in susceptible people.

Moreover the chromic acid that is absorbed onto the cellulose and is liberated on precipitation of the chromium arsenate is a known oxidising agent, which will oxidise most organic compounds including cellulose and lignin which comprise the cell walls of the fibres, tracheids, and parenchyma cells of sapwood. Such oxidation results in weakening of the cell walls and tends to accentuate the cracking and checking of the sapwood during periods of stress such as during seasoning.

Another disadvantage is that a seasoning step must be carried out prior to treatment. It has been found that when dry wood is immersed in a preservative solution there is a rapid absorption of the solution by the outer layers. This causes swelling which has the effect of closing the inner passages and rapidly retarding the rate of absorption of liquid. Subsequent uptake of liquid is surprisingly slow. This applies to hardwood in particular where fibres comprise a significant portion of the sapwood. As the solution progresses radially towards the hardwood, there is a tendency for the fibres to close up and impede the progress of the solution.

In the case of porous softwoods, such as pinus radiata the presence of trachieds means that there is less likelihood of swelling affecting the transport of the solution and since ray parenchyma cells provide rapid radial access for solution there is a tendency for the solution to quickly flood the system. This is one of the main reasons why softwoods have been successfully preserved using CCA solutions.

Failure of eucalypt species treated by CCA vacuum pressure techniques is reported to be widespread. It is reported that over 50% of the poles treated in the state of Queensland (Australia) with CCA salt have been subject to attack by soft rot. There is widespread failure reported throughout areas of New South Wales (Australia).

A market survey indicates that the preservation of poles both by oil-based and water-based preservatives in New South Wales is declining. A practice is developing of using eucalypt poles with a known durable hardwood and a thin sapwood and removing the sapwood at ground level. It is reported that the added cost of preservation is not providing sufficient additional life to warrant the expense.

OBJECT OF THE PRESENT INVENTION

The object of the present invention is to provide a process which overcomes the problems hitherto encountered in preserving wood, in particular hardwood, against fungal and/or insect attack and has the following advantages:

(i) the process is adaptable to all types of wood, (ii) the compounds fixed in the wood by the process have sufficiently low solubility to resist leaching but are sufficiently available to act against wood attacking organisms, (iii) the process is relatively short compared to conventional processes, (iv) the process does not require expensive apparatus and may be carried out using conventional and/or relatively inexpensive new apparatus, (v) the process is economical in that the cost of the process is recouped by the increased life span of the treated wood, (vi) the process may be altered in accordance with the condition to which the treated wood will be subjected, (vii) a seasoning step prior to treatment is not required thus minimising borer attack, (viii) the compounds which preserve the wood against attack are uniformly distributed throughout the wood, (ix) chromates which do not act as preservatives and which discolour the wood are not formed, and (x) the tendency of wood to check and crack is reduced.

SUMMARY OF THE PRESENT INVENTION

In its broadest aspect, the present invention provides a process for preserving wood against fungal and/or insect attack comprising a fungicide treatment wherein a copper solution or a copper and arsenic solution is introduced into the wood system whereupon the pH of the wood system falls to about 2, wherein in the case of hardwoods (as hereinafter defined) the wood is heated in the presence of moisture prior to or simultaneously with the introduction of said solution; and subsequently or simultaneously, or if a copper and arsenic solution is used in the fungicide treatment and/or, an insecticide treatment wherein a chromium and arsenic solution is introduced into the wood system whereupon the pH slowly rises to at least 2.8 and tertiary chromium arsenate is fixed; wherein if copper and arsenic are introduced into the wood system then the pH of the system is controlled so that the pH rises to at least 3.2 whereupon basic copper arsenate is fixed, and wherein if copper is introduced simultaneously with the chromium and arsenic, the sapwood must be at a temperature of at least 40° C. and thereafter allowed to cool.

The term "hardwood" as used herein denotes hardwoods and "difficult to treat" or refractory softwoods which have a reactive substrate.

If wood is to be placed in areas of high fungal attack but low insect attack then a one-step fungicide treatment provides sufficient protection. On the other hand, if wood is to be placed in areas of low fungal attack but high insect attack, then a one-step insecticide treatment suffices. Where both fungal and insecticide attack prevails, then a one or two step fungicide and insecticide treatment is necessary.

GENERAL DESCRIPTION

It has been found that green unseasoned wood may be treated thus eliminating the seasoning step which is required prior to conventional techniques such as the CCA vacuum pressure technique.

A further discovery has been that copper, arsenic and chromium can be introduced into the wood without the formation of chromates which discolour the wood and which do not act as preservatives by controlling the pH. The end products formed are the desired preservatives. By controlling the pH it has also been found that the amount of chromic acid which causes cracks and checks in the wood can be reduced. The preferred method for controlling the pH is by applying heat.

It has furthermore been found that the process can be varied to suit the conditions in which the wood is to be placed. If the wood is to be placed in areas of high fungal attack but low termite attack then only a fungicide treatment step may be needed. Alternatively, when there is high risk of termite or borer attack but little risk of fungal attack only an insecticide treatment step may be required.

It has also been found that for the prevention of fungal decay, copper and arsenic has been shown to provide the most effective protection. Basic copper arsenate is recognised as being the most insoluble form of copper and arsenic and as providing a satisfactory level of fungicide protection. Precipitates of copper and arsenic retained in wood in concentrations preferably above 0.1% W/W, more preferably above 0.15% W/W copper have been found to provide superior protection against attack by fungus under highly hazardous conditions.

For protection of wood against insect attack, particularly termites, arsenic, especially in the form of tertiary chromium arsenate a highly insoluble form of arsenic, has been recognised as an economical and effective preservative. For adequate protection, an arsenic level above 0.03% is preferred.

In a preferred embodiment, soft wood, as well as hardwood is heated in the presence of moisture, preferably steam heated, to remove extractives in the wood substrate.

The extractives, sugars and amino acids etc., react with the components of CCA formulations and also act as a food source for fungus and insects.

The composition of the substrate is important when considering preservation methods. The substrate component largely determines the ease with which fungus can develop and overcome the inhibitory effect to the toxicant. It has been found that considerably more toxicant may be needed to control fungal growth in hardwoods than in softwoods. More toxicant may thus be needed to stop fungal development when the substrate is readily utilised by the fungus.

It is therefore necessary in the treatment of hardwoods having a reactive substrate to remove the extractives prior to treatment.

Thorough soaking of wood prior to treatment establishes a homogeneous system throughout the wood. With the increase in moisture content the wood cells of both the heartwood and sapwood swell. By immersing in hot water, water vapour pressure expels any air and largely fills the voids in the cells.

Regarding the fungicidal formulation, the preferred copper solution is copper sulphate, although other equivalent copper salts may be used. The concentration of the copper solution is not critical and generally is a function of the hazard to which the treated wood will be exposed. For groundline exposure under tropical and sub-tropical conditions a concentration of 8% to 10% by weight copper sulphate is preferred.

It is also preferred to use copper and arsenic solution as the fungicidal formulation. The copper and arsenic solution preferably comprises copper sulphate and arsenic pentoxide or equivalent salts in a mole ratio of 2 to 1 Cu to As. A fungicidal formulation consisting of approximately four parts of copper sulphate to one part of arsenic pentoxide up to 10% strength has been found to be toxic to a broad range of fungi.

The copper (and arsenic) solution is introduced into the wood while the wood is still green and in a homogeneous state so that the copper (and arsenic) ions are effectively and uniformly dispersed throughout the sapwood. The application of heat to the wood containing the fungicidal formulation or the heating of the fungicidal formulation enables the copper (and arsenic) ions to diffuse rapidly and evenly through the sapwood.

When the fungicidal formulation comprises a copper and arsenic solution, it is essential that the pH of the solution be controlled. The pH of most wood is about 4 to 4.5 and when the solution which has a pH about 2 or less is introduced, the pH of the wood falls to about 2.0. At pH $<2.8$, there is little likelihood of copper and arsenic salts precipitating, thus ensuring uniform distribution of copper and arsenic.

Copper fixes to the wood by ion exchange thereby releasing hydrogen ions, causing the pH to drop, whereupon copper in the form of copper sulphate reacts with arsenic and produces as a by-product, sulphuric acid, causing the pH to drop still further. Acid copper arsenate Cu H $AsO_4$ is a soluble salt which is stable at pH 1 to 2.8 and because the pH is low when the copper and arsenic solution is first introduced, the environment is favourable to the formation of this species. This salt is unstable above a pH of 2.8 and because the pH rises as the reaction proceeds, the salt decomposes releasing copper arsenate ions which are free to fix to the wood as well as form copper ortho arsenate which is stable at pH 2.8 to 3.2. Basic copper arsenate $Cu(OH)CuAsO_4$ which is an insoluble form of copper and arsenic is stable above pH 3.2 and is the desired form of precipitate for both copper and arsenic. To enable this salt to form, it may be necessary to immerse the wood in a second solution (for example $Na_2AsO_4$) so as to adjust the pH to a level above 3.2 whereupon copper ortho arsenate decomposes and basic copper arsenate is precipitated.

To promote the reaction and ensure that the liquid phase is homogeneous and that the salt and ions are rapidly dispersed throughout the sapwood of hardwoods and optionally of softwoods, heat is applied. It is preferred that the temperature of the sapwood reaches at least approximately 60° C. more preferably to 75° C. The method of heating depends on the method used to introduce the copper (and arsenic) solution.

In the case of a hardwood pole of substantial length, a preferred method is by sap displacement. The method makes use of tight fitting caps which are heat shrunk to the butt and top ends of the pole. A reservoir of fungicidal formulation is gravity fed to the butt end of the pole. At the top end of the pole, a vacuum is applied and the pressure gradient forces the formulation through the sapwood. A pipe attached to the top end leads to a storage container for sap and any formulation forced through the pole.

An alternative is to soak the wood in a bath of the fungicide formulation preferably heated to a temperature of between 85° C. and 90° C. for about 3 to 8 hours, so that the wood reaches a temperature of approximately 60° C. As the solution is highly corrosive stainless steel is required. Where the sap displacement method is used or when the bath is not heated, the wood, after treatment, may be placed in a vessel and the environment heated with steam to a temperature of 100 degrees centigrade until the temperature of the outer wood layers reaches approximately 60° C.

It is known that certain species of fungi are more tolerant than others to the toxic copper ion but these more tolerant species are susceptible to the toxic arsenic ions. The copper and arsenic salt formed by the present process provides a more efficient protection against fungus than is the case when copper and arsenic are impregnated by CCA vacuum pressure techniques. The copper and arsenic fixed by ion-exchange by the present process becomes part of the wood substance and as such forms a systemic fungicide when complexed with the wood. The basic copper arsenate which complexes within the wood matrix is superior to copper arsenates which precipitate as a prophylactic fungicide which adheres to the wood fibres.

It is believed that the reason why CCA salts have failed when impregnated into hardwoods is that immediately after impregnation the pH rises rapidly to a range 3.0 to 3.5 and over a period of 50–100 hours to a value as high as 6. Such an environment is favourable to the formation of complex copper chromium salts which do not fix to the wood and are not recognised as being in a form to act as a preservative.

Where an insecticide treatment is desired, the wood is treated with a chromium and arsenic solution. Where an insecticide as well as fungicidal treatment is required, the insecticide treatment may follow or may occur simultaneously with the fungicide treatment.

Where the insecticide treatment occurs simultaneously or subsequently with the fungicide treatment it is essential that the wood temperature does not fall below 40° C. preferably 50° C., more preferably 60° C., when the chromium and arsenic are initially introduced into wood.

The chromium and arsenic solution used in the insecticide treatment preferably comprises a solution of sodium dichromate or chromic oxide and arsenic pentoxide or equivalent salts. The mole ratio of Cr to As is preferably in the range 1 to 1.0 to 1 to 1.9. The salt concentration may be varied according to the hazard to which the wood is exposed with concentrations of up to 10% preferred. Where a fungicidal treatment step using a copper (and arsenic) solution has not been carried out, it may be necessary to increase the arsenic content.

By maintaining the wood above 40° C. more preferably above 50° C. when the chromium and arsenic solution is initially introduced, the rate of rise in pH and the type of equilibria that are established are controlled.

In addition while the temperature of the sapwood remains above 40° C., the chromium and arsenic ions migrate through the wood by ionic diffusion. The elevated temperature also accelerates the diffusion and fixation of the copper arsenic fungicide solution, if present. Hydrolysis of ortho copper arsenate and acid copper arsenate to basic copper arsenate is negligible at very low temperatures, but at temperatures of approximately 60° C. the rate of formation of the basic copper arsenate is sufficient to ensure final precipation of the basic copper arsenate when the wood system is in a homogeneous aqueous phase and the pH is at least 3.2

$$2CuHAsO_4 + H_2O \xrightarrow{pH3.2} Cu_2(OH)AsO_4 + H_3AsO_4$$

It has been found that at temperatures above 40° C. the adsorption bond between chromic acid and the wood weakens and chromic acid is released. The pH tends to fall further. It has also been found that the basic chromates (for instance chromic chromates) which are undesirable precipitates form at above pH 3.5 and temperatures below 40° C. and therefore it is essential that the temperature is at least 40° C. when the chromium and arsenic solution is introduced into the wood system.

Chromium arsenate is less soluble than the chromic chromates which form as the pH rises above 3.5 and it is therefore possible by heating the sapwood to at least 40° C. to minimise the adsorption of chromic acid on to the wood and thereby retard the rate at which the pH rises. After the wood reaches at least 40° C. it may be allowed to cool. Chromic acid adsorbs slowly onto the wood at temperatures less than 40° C. and the pH will rise. The chromium is reduced from a valency of +6 to a valency of +3 and above pH 2.8 it reacts with the arsenate ion to form the desirable chromium arsenate precipitate, thereby fixing most of the chromium before basic chromic chromates which are stable above pH 3.5 are able to form. The excess of arsenic ensures that chromates do not form and thus eliminates the greenish yellow hue that is characteristic of wood containing chromate precipitates.

At pH levels below 2.8, fixation is predominantly by ion exchange. Above pH 2.8 fixation is by precipitation within the wood matrix and within the cells of the desirable chromium arsenate and basic copper arsenates.

At pH less than 2.8 a complex stable chromium arsenate of the general formula $H_mCr_{(3-m)/3}AsO_4$ exists in equilibrium with the chromic acid arsenic acid. Chromium arsenic ions (such as $HCrAsO_7^{-2}$) and $H_2Cr_2O_7$ may also be present and such ions are free to fix by ion exchange to the wood. Chromium at a valency of +6 is fungicidally active.

While the pH is below 3.5 (and temperatures above 40° C.) the copper-arsenic and chromium-arsenic systems exist independently of each other with the copper and arsenic forming the fungicide and the chromium and arsenic forming the insecticide. As the pH rises above 3.5 (and the temperature falls below 40° C.) the equilibrium tends towards the reduction of chromium (30 6) to chromium (+3).

Chromium and arsenic solution may be introduced into the wood using known techniques. The techniques used depend on the method of applying heat and on the type of equipment available.

The chromium and arsenic may be introduced into the wood by sap displacement. A pole pressure cap is fixed to one end of the green felled log, said cap being attached to a reservoir containing a solution containing chromium and arsenic and said solution is forced under pressure through vessels in the sapwood of the log. The reservoir is mounted well above the pole so that the static pressure of the liquid column forces the solution through the vessels in sapwood.

Alternatively, a pole pressure cap may be fitted to the butt end of the pole. The solution containing arsenic and chromium is then pumped at a pressure usually between 70 and 100 psi through a filter and a high pressure hose connected to the pole pressure cap. The solution is then forced under pressure into the vessels of the sapwood mixing with and displacing the sap present in the sapstream. The pumping operation continues until the effluent from the top of the pole substantially comprises the chromium and arsenic solution. This may be detected by measuring the specific gravity.

Where logs are unsuitable for fitting a pole pressure cap or in cases where it is inconvenient or in the case of sawn timber, impregnation may be by vacuum pressure techniques or hot diffusion techniques. Of the two the hot diffusion process is preferred.

In the vacuum pressure process a solution containing between ½% and 5% of chromium and arsenic is forced in to seasoned wood by the usual vacuum pressure techniques.

For the hot diffusion process the wood may be placed in a hot water bath so as to raise the sapwood temperature to about 60° C. and then transferred to a bath of sodium bichromate and arsenic pentoxide with a mole ratio of Cr to As of 1 to 1 at a temperature of about 70° C. and allowed to cool.

In an especially preferred embodiment of the invention, a one-step fungicide and insecticide treatment is used. The wood is prepared by heating to a temperature in excess of 50° C., preferably 60° C. In the case of hardwood and refractory softwoods, the sapwood of which contains extractives which are reactive with the copper, arsenic and chromium salts, it has been found that the best method of heating is to place the wood in water heated to approximately boiling point. Not only is the wood heated but reactive extractives are removed and a homogeneous liquid phase is established within the wood. In the case of wood having porous sapwood (e.g. the pinus species) it has been found that the best method of heating is by steaming the wood in a kiln so as to thoroughly heat the wood, vaporize the sap and drive out any air.

A CCA solution comprising copper chromium and arsenic in a mole ratio of copper to arsenic to chromium of 2:1:1 is prepared in a wooden vat and heated to a temperature of approximately 60° C. The concentration of the solution can be varied in strength depending on the conditions to which the wood will be exposed. The wood while still hot is immersed in the heated solution and the solution is then allowed to cool. For some species of wood with a low native pH, it may be necessary to include a slight excess of chromium ion to ensure that sufficient chromium adsorbs onto the wood to permit the pH to rise. The pH of the prepared CCA solution is below 2, usually about 1.8. The pH of the wood while the temperature remains above 40° C. is about the same. As the wood slowly cools, the desired reactions occur within the wood. There will be instant ion exchange fixation to saturation of copper to the wood as well as fixation to the wood of the $(Cr(CrO_4)_3)^{-3}$ ion.

The equilibrium reaction of the chromium is $$H_mCu_nCr_{(3-2n-m)/3} \rightleftarrows CrAsO_4$$

and the equilibrium reaction of the copper and arsenic is $$H_mCu_{(3-m)/3}AsO_4 \rightleftarrows Cu_3(AsO_4)_2$$

At a wood temperature above 40° C., these equilibria will be established independently of each other. The pressure of wood drastically changes the equilibria conditions inside the wood as the temperature falls below 40° C. due to the adsorption of chromic acid onto the wood. The pH of the wood system rises with the subsequent reduction of hexavalent chromium to trivalent chromium. The rate of reduction is quite high below pH 3.0.

The chromic acid will react with reducing agents and fixation proceeds producing various equilibrium compounds. At pH 2.8 chromium arsenate and copper ortho arsenate are the stable forms and precipitate. At pH 3.2, basic copper arsenate becomes the stable form and will precipitate or fix as a complex within the wood. The pH of the solution outside the wood remains below 2.

Another method of introducing CCA salts into the wood is to prepare the CCA solution in a wooden vat and heat it to a temperature of approximately 70° C. The green wood to be treated is charged into the vat in a basket such that the orientation of the vessels or tracheids is substantially vertical. Heat is applied to the bottom of the vat by direct injection of hot air. The sap in the wood will be displaced vertically as the temperature rises and the sap replaced by CCA solution.

The process according to the present invention may also be adapted for preserving softwood or wood which is normally treatable by vacuum pressure techniques using CCA solution. It is possible to use existing equipment to apply the hot diffusion process. The unseasoned wood is placed in a vessel and steamed so that the temperature of the wood reaches at least 60° C., preferably 90° C., so as to expel the air from the voids and fill the voids with water vapour. The vessel is then flooded with a cold solution of CCA salts. The water vapour in the wood cells will condense on contact with the cold solution and solution will flood into the voids. Infusion of the solution occurs rapidly and diffusion through the wood cell walls occurs while the wood is still hot. Pressure may be applied if required to hasten infusion but it is not essential. It is generally necessary to increase the amount of chromium to a level higher than the stoichiometric amount required to satisfy the insecticide and fungicide reactions, in order to protect the mild steel equipment against corrosion. In the case where only fungicide protection is required sufficient chromium need only be added to protect the equipment. The amount of chromium required may vary according to judgment, the corrosion factor being weighed against the saving on chromium salt used. It is considered that the chromium content may be reduced to a level of 20% of the total salts added without causing undue corrosion. A further advantage of this process is that a registered pressure vessel is not a necessity and non-pressure vessel may be used.

The rate of cooling and reaction rate can be accelerated by applying a vacuum. This can be done in the vacuum chamber normally used for vacuum pressure application. This will also remove excess solvent from the cells and recover unused salts and assist in the seasoning process. The rate of reaction is considerably accelerated by the application of heat and provided the temperature of the wood does not drop below 35°–40° C. reaction should be completed within hours. On completion of the process the wood is allowed to dry. Once the reactions are completed the wood may be kiln dried or air-seasoned.

The process of the present invention in particular the embodiment using diffusion techniques and a one-step operation has numerous advantages over the conventional CCA vacuum pressure process. The whole process can be carried out in relatively cheap simple equipment the capital cost of which is less than 20% of the cost of the vacuum pressure plant.

Chromium is included in the CCA formulations for vacuum pressure as a mordant and acts as an intermediary in the process and a pacifying agent to protect equipment against corrosion. The bulk of the chromium ultimately is precipitated as chromium hydroxide which is not recognised as having any use. In many formulations the chromium content makes up 35–45% of the formulation, which ultimately is not of use. There is a significant saving in raw material as a result of the reduced chromium demand.

By comparing similar wood treated by the conventional vacuum pressure process or double diffusion method with wood treated by the present invention can be shown from discs cut from the wood, that radial penetration and fixation of the copper and arsenic is greater than that of the conventional methods. Further, there being no disproportioning of the solute as the solvent penetrates by diffusion, the preservative will be distributed more evenly throughout the zone of preservation.

A further advantage of the process according to the present invention is that the wood is treated while in a green state. By immediately treating the felled and sawn timber original infestation of the wood by insects such as lyctids or fungus can be prevented.

There is a still further advantage in that the felling carting to the mill or treatment plant sawing and treating to an order book, has an advantage that the timber can be marketed much earlier and hence there is less requirement for working capital to finance stocks, while timber seasons in preparation for preservation the vacuum pressure treatment.

Wood treated according to the present invention does not suffer from colour variability or intensity that results when wood treated cold by vacuum pressure. Drying and exposure to light must be avoided in the conventional vacuum pressure treated wood in order that primary fixation takes place away from ultra violet light, and it is necessary to keep freshly impregnated timber under cover during the critical primary fixation period before drying in the normal way.

Another advantage of the present invention stems from the reduced chromium content of the wood compared to wood treated by CCA vacuum pressure techniques. With reduced chromium content the formation of chromic acid is reduced and the likelihood of excess chromic acid oxidising the wood reduces the propensity of the wood to crack during seasoning.

The following example illustrates one embodiment of the present invention.

EXAMPLE

Green unseasoned wood is placed in water heated to approximately boiling point and the wood heated to about 60° C. A CCA solution containing copper sulphate, sodium dichromate and arsenic pentoxide in a mole ratio of Cu:Cr:As of 2:1:1 at a concentration of between 3% and 7% copper sulphate is made up and heated to a temperature of approximately 60° C. The wood while it is still hot is immersed in the hot CCA solution and the wood and solution allowed to slowly cool. When the reactions within the wood are completed (which may take up to 6 days) the wood is then placed out to air season or is kiln dried.

In conclusion, the preferred nature of much of the foregoing description is stressed. As long as the basic criteria as broadly defined or observed, any matters falling there within not being critical in themselves, can be varied in accordance with the situational and/or environmental requirements.

I claim:

1. A process for preserving wood comprising the steps of:

providing a solution containing copper ions, arsenic acid ions and chromic acid ions, the ratio of copper to arsenic being such as to establish acid copper arsenate equilibrium at a pH of less than 2.8 and at a temperature greater than 40° C., said solution having a sufficient concentration of chromic acid ions to establish tertiary chromium arsenate equilibrium, and to provide a ratio of chromium to arsenic which will ensure that substantially all arsenic is precipitated and fixed as tertiary chromium arsenate when the pH rises to about 2.8, placing the wood in a bath of the solution and heating acid bath to maintain the temperature of the wood above at least about 40° C. for a time sufficient to ensure that the copper ions, arsenic acid ions and chromic acid ions diffuse through the wood whereby the pH of the aqueous phase within the wood falls below 2.8 and acid copper arsenate equilibrium is established, cooling the bath and the wood to below about 40° C. so that the chromic acid ions adsorb onto the cells of the wood whereby the pH of the aqueous phase of the wood rises causing (a) substantially all of the chromium to be precipitated and fixed within the wood as tertiary chromium arsenate when the pH rises to about 2.8, and (b) basic copper arsenate to be precipitated and fixed within the wood when the pH rises to about 3.2, the concentration of the chromic acid in said aqueous phase being such that the pH of said aqueous phase remains below 4 until the aforesaid precipitation and fixation reactions are substantially completed, thereby preventing formation of chromates within and on the surface of the wood.

2. A process according to claim 1 wherein the wood is preheated in the presence of water to a temperature of above about 40° C. prior to placing it in the bath.

3. A process according to claim 1 wherein the temperature of the wood in the bath is raised to above about 50° C. during said heating step.

4. A process according to claim 1 wherein the bath is pressurized to hasten the infusion of the copper ions, arsenic acid ions and chromic acid ions into the wood.

5. A process according to claim 1 wherein the vacuum is applied during the cooling of the wood to assist the cooling and to withdraw excess solution from within the wood.

6. A process according to claim 1 wherein the ratio of copper to chrome of arsenic is 2:1:1.

7. A process for preserving wood comprising the steps of:

providing a solution containing arsenic acid ions and chromic acid ions, the concentration of the chromic acid ions being sufficient to establish tertiary chromium arsenate equilibrium and to provide a ratio of chromium to arsenic which will ensure that substantially all arsenic can be precipitated and fixed as tertiary chromium arsenate at a pH of about 2.8, placing the wood in a bath of the solution and heating said bath to maintain the temperature of the wood above about 40° C. for sufficient time to ensure that the arsenic acid ions and chromic acid ions diffuse through the wood, cooling the bath and the wood to below about 40° C. so that the chromic acid ions adsorb onto the cells of the wood whereby the pH of the aqueous phase of the wood rises causing substantially all of the chromium to be precipitated and fixed within the wood as tertiary chromium arsenate when the pH rises to about 2.8, the concentration of the chromic acid ions in said aqueous phase being such that the pH of said aqueous phase remains below 4 until the aforesaid precipitation and fixation reactions are substantially completed, thereby preventing formation of chromates within and on the surface of the wood.

8. A process according to claim 7 further comprising preheating the wood to at least about 40° C. before the wood is placed in the bath.

9. A process according to claim 7 further comprising providing in the solution chromium to arsenic in a mole ratio of 1:1.0 to 1:1.9.

10. A process according to claim 9 further comprising providing a salt concentration of up to 10%.

11. The process of claim 1 or 7 further comprising preheating the wood in water heated to approximately boiling prior to introducing the wood to the bath of the solution.

* * * * *